US005951276A

United States Patent [19]

Jaeschke et al.

[11] Patent Number: 5,951,276

[45] Date of Patent: Sep. 14, 1999

[54] ELECTRICALLY ENHANCED HOT SURFACE IGNITER

[76] Inventors: James R. Jaeschke, 2314 Misty La, Waukesha, Wis. 53092; Gordon B. Spellman, 11305 N. Bobolink La. 30W, Mequon, Wis. 53186

[21] Appl. No.: 08/865,674

[22] Filed: May 30, 1997

[51] Int. Cl.[6] ..... F23N 5/00; F23Q 1/04

[52] U.S. Cl. ..... 431/66; 431/67; 431/254; 219/497

[58] Field of Search ..... 431/66, 67, 254, 431/258, 259; 219/497, 262, 263, 264

[56] References Cited

U.S. PATENT DOCUMENTS

| | | | |
|---|---|---|---|
| 3,700,933 | 10/1972 | Harkenrider et al. | 219/497 |
| 3,778,218 | 12/1973 | Wright et al. | 431/67 |
| 3,860,169 | 1/1975 | Norman | 219/497 |
| 4,002,419 | 1/1977 | Hantack et al. | 431/66 |
| 4,162,379 | 7/1979 | Sebens et al. | 219/497 |
| 4,265,612 | 5/1981 | Romanelli et al. | 431/66 |
| 4,306,853 | 12/1981 | Rippelmeyer | 431/66 |
| 4,323,342 | 4/1982 | Sommers, Jr. et al. | 431/66 |
| 4,334,147 | 6/1982 | Payne | 219/497 |
| 4,444,551 | 4/1984 | Mueller et al. | 431/66 |
| 4,671,484 | 6/1987 | Bergquist et al. | 431/66 |
| 4,858,576 | 8/1989 | Jeffries et al. | 219/497 |
| 4,925,386 | 5/1990 | Donnelly et al. | 431/66 |
| 4,934,925 | 6/1990 | Berlincourt | 431/67 |
| 5,035,607 | 7/1991 | Peterson | 431/66 |
| 5,039,842 | 8/1991 | Kochajda | 219/497 |
| 5,133,656 | 7/1992 | Peterson | 431/66 |
| 5,435,717 | 7/1995 | Bohan, Jr. et al. | 431/66 |
| 5,504,306 | 4/1996 | Russell et al. | 219/497 |
| 5,669,038 | 9/1997 | Kishimoto | 219/497 |
| 5,704,775 | 1/1998 | Gilbert | 431/66 |
| 5,725,368 | 3/1998 | Arennsmeier | 431/66 |
| 5,729,456 | 3/1998 | Boisvert et al. | 219/497 |

*Primary Examiner*—James C. Yeung
*Assistant Examiner*—David Lee
*Attorney, Agent, or Firm*—Terrence Martina; J. J. Morris; Sean Detweiler

[57] ABSTRACT

An electronic control circuit (10) for a gas oven including a hot surface igniter (24) which is heated through the application of electrical current to a temperature sufficient to ignite gas supplied through an electrically actuable gas valve (26). The applied current is regulated by a micro-controller (20) which controllably gates on a triac (14) while taking into consideration a sensed current level.

13 Claims, 3 Drawing Sheets

ELECTRICALLY ENHANCED HOT SURFACE IGNITER

BACKGROUND AND SUMMARY OF THE INVENTION

This invention relates generally to electronic oven control circuits and, more particularly, to an electronic oven control circuit for a gas oven having a hot surface igniter.

Gas oven control systems which utilize hot surface igniters, resistive elements which are heated by the application of electrical current, are widely used because of their durability and reliability. The hot surface igniter is generally positioned in the path of flow of a fuel gas or gas/air mixture, this flow being controlled with an electrically actuable valve. An electronic controller applies current to the igniter until it reaches a temperature high enough to cause ignition of the gas and then provides a signal which causes the valve to open. As the gas passes the hot surface igniter, the gas is ignited and heat is produced.

While such systems are typically very effective, there is always a need for improved systems which provide enhanced functionality at a lower cost. In this regard, the electronic control circuit of the present invention provides a simple and inexpensive hot surface igniter control circuit which has constant current control capability. The hot surface igniter is connected in series between a power supply and a bi-metal operated gas valve. A triac operated under the control of a micro-controller controls the density of pulses applied to the triac and valve. The electrically operated valve is energized to a level which causes it to open only when current passed through the hot surface igniter has heated it to a sufficient gas ignition temperature. A regulating loop is used to monitor the current level in the circuit and to feed this information back to the micro-controller in order to maintain a desired constant current level.

This configuration produces a gas oven control system which is simple and economical as well as which provides improved reliability. These and other features and advantages of the present invention will become apparent upon review of the following description taken in conjunction with the accompanying drawings.

DETAILED DESCRIPTION OF THE PREFERRED EMBODIMENTS

Figure 1:
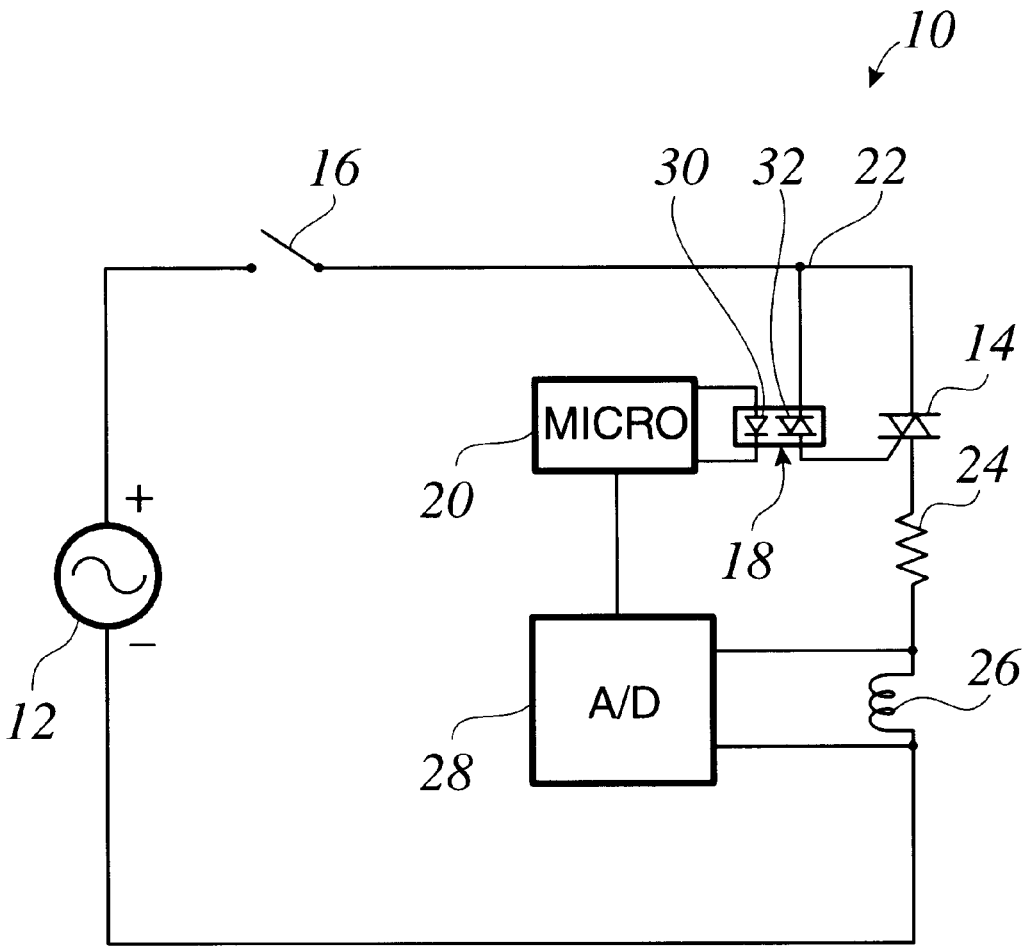
FIG. 1 is a schematic circuit diagram of the hot surface igniter circuit of the present invention.

Turning now to the drawings, and in particular to FIG. 1, an electronic oven control circuit made according to the teachings of the present invention is indicated generally at 10. Circuit 10 is powered by an alternating current (ac) power supply 12 which is connected in series to a triac 14, through a thermostat switch 16. Switch 16, preferably a relay contact or similar device, is closed in response to a signal from the main oven controller which is issued in response to a need to raise the temperature level in the oven. However, while the present invention is described herein as being part of a domestic gas range oven, it should be readily appreciated that the present control circuit is equally well suited for many other similar gas burner applications.

An opto-triac isolator 18 is connected to a micro-controller 20 and to a junction 22 between triac 14 and thermostat 16. Triac 14 is connected in series with the hot surface igniter 24 and a gas valve 26 which preferably has a bi-metal heating element which controls the opening or closing of the valve with heat. Valve 26 is fluidly connected to a source of fuel gas (not shown) and igniter 24 is positioned in the path of gas flow. An analog-to-digital converter (A/D) 28 is connected across valve 26 and to micro-controller 20.

When thermostat switch 16 closes, due to a call for heat in the oven, a voltage from source 12 is applied to triac 14, igniter 24 and valve 26. A/D 28 converts the amount of current across valve 26 into a digital value which it transmits to micro-controller 20. Based upon the digital current value provided by A/D 28, and a desired operating current of valve 26 and igniter 24 which has preferably been pre-programmed in micro-controller 20, controller 20 outputs a signal to energize light emitting diode (LED) 30 of opto-triac 18. While an A/D converter is used in the measurement of current across valve 26, any other suitable means for providing this measurement could alternately be used.

When LED 30 is energized, triac 32 is gated on. With triac 32 on, triac 14 is gated on and, once gated at the beginning of each half cycle of alternating current, remains conductive during the remainder of each half-cycle. This produces a controllable pulse density thereby providing a controllable duty cycle in a manner well know to those of skill in the art. Alternately, however, other suitable means for controllably gating triac 14 on and off could also be used.

As current flows through igniter 24, it heats up, eventually to a temperature sufficient to ignite the gas. At the same time, the current flowing through valve 26 causes its bi-metal heating element to increase in temperature. Once the heating element has reached a certain temperature, valve 26 opens, allowing gas to flow across igniter 24 and be ignited. However, while the exemplary embodiment of the present invention described herein utilizes a bi-metal gas valve, it can be appreciated that any other suitable electrically actuable valve means could alternately be used.

In order to make the system work effectively, the various components of circuit 10 are carefully selected such that the current needed to heat igniter 24 to a sufficient gas ignition temperature is below that necessary to hold valve 26 in a closed position. The operating current regulated by micro-controller 20 is also set to be above the threshold current for causing valve 26 to open. Generally, this desired operating current is selected based upon the various device ratings provided by the respective device manufacturers but other factors apparent to those of skill in the art could be considered as well. For instance, consideration can also be given to various additional factors which could affect the attainment of the ignition temperature such as the cooling effect caused by the flow of gas over the igniter and certain inherent characteristics or manufactured discrepancies between igniters.

Preferably, micro-controller 20 is programmed to maintain igniter 24 at a temperature which is at or near the minimum temperature needed to effect ignition of the gas so as to avoid operation at a maximum rated temperature. Since the temperature span between the lowest ignition temperature and the maximum rated temperature can sometimes be narrow, the feedback loop between A/D 28 and controller 20 constantly works to adjust the current and to keep it at a desired constant value. Alternately, however, micro-controller 20 can be programmed to modulate the current according to a predetermined schedule so as to rapidly attain ignition temperature and then maintain it.

In addition to providing a simple and economical gas ignition control circuit, the design of and configuration of circuit 10 also provides reliable operating conditions even in the event of a circuit malfunction. The regulating loop formed by A/D 28, micro-controller 20 and opto-triac 18 provide constant current even when the line voltage varies. In the event of an open circuit, no current flows and valve 26 remains closed. A short circuit, on the other hand, generally will cause the house circuit breaker to blow. Even if the short occurs between the igniter and valve, the igniter may heat up but the valve won't open. In addition, micro-controller 20 can be programmed to look for abnormalities such as continued or irregular changes in pulse density. This information could also be used to otherwise provide some type of warning.

Figure 2:
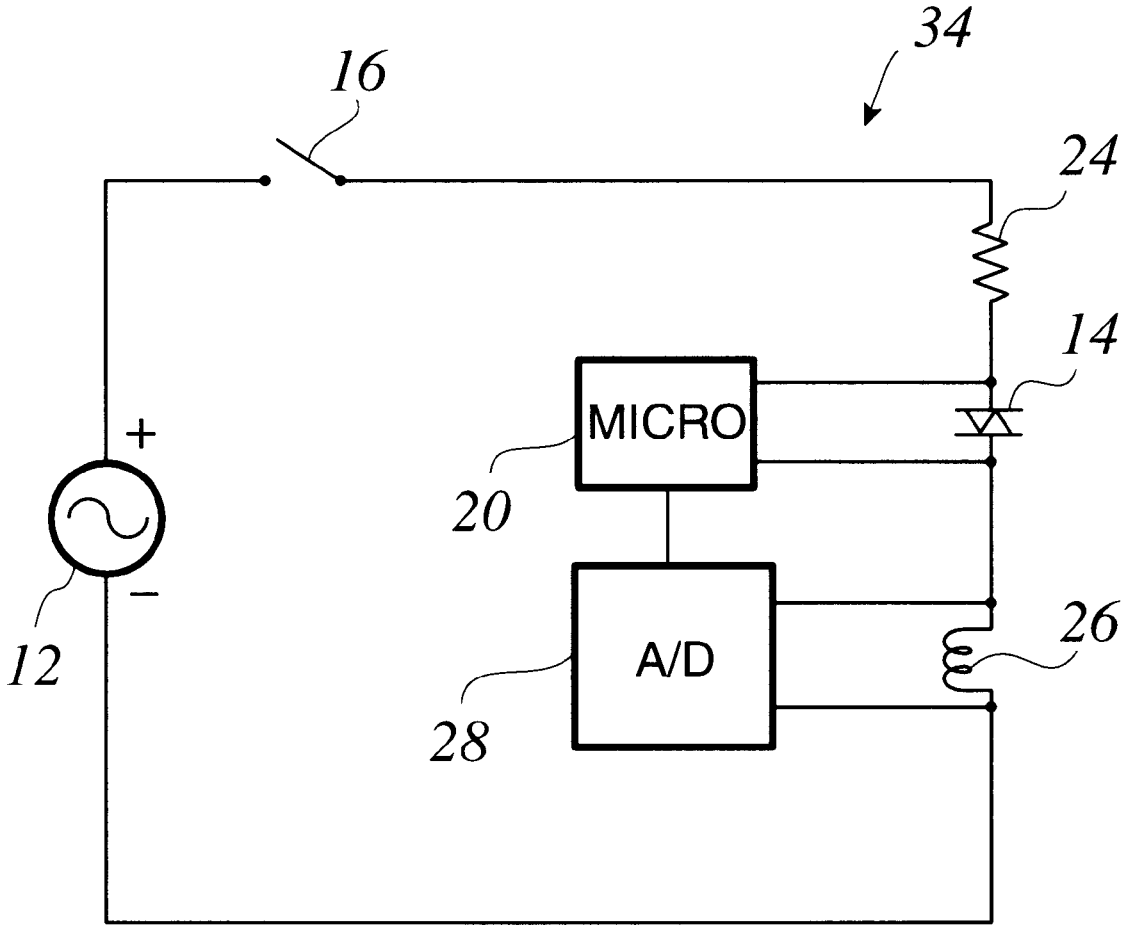
FIG. 2 is a schematic diagram similar to FIG. 1 illustrating an alternate embodiment of the present invention.

Turning now to FIG. 2, an alternate embodiment of the present electronic control circuit is indicated generally at 34. In this alternate configuration, triac 14 is positioned between igniter 24 and valve 26. Micro-controller 20 is connected directly across triac 14 and is connected to A/D 28 which, in turn, is connected across valve 26. While providing a slightly simpler wiring configuration, circuit 34 operates in a fashion analogous to circuit 10.

Figure 3:
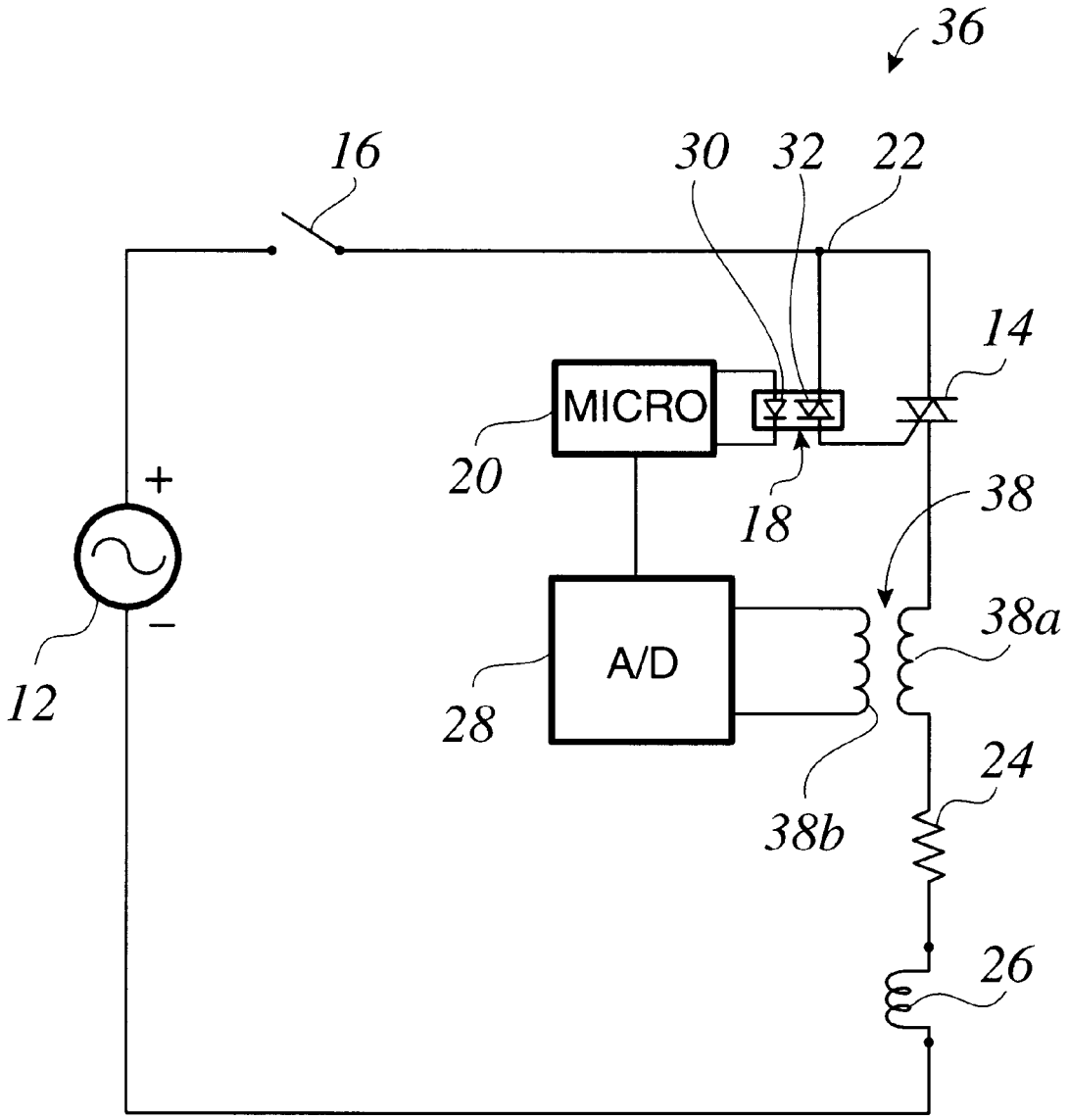
FIG. 3 is a schematic diagram similar to FIG. 1 illustrating yet a further embodiment of the present invention.

Turning finally to FIG. 3, yet another embodiment of the present control circuit is indicated generally at 36. This circuit is similar to those shown in FIGS. 1 and 2, and could employ the opto-triac 18 of circuit 10 or be wired in the manner of circuit 34, except that a current transformer 38 is wired in series with valve 26, preferably with the primary winding 38*a* wired in series with igniter 24 and with A/D 28 connected across the secondary winding 38*b*. While this adds slightly to the overall cost of the control circuit, it is useful where a more accurate current measurement through valve 26 is desired.

Thus, the present invention provides a simple and inexpensive control system for a gas oven or similar gas operated device having a hot surface igniter. By providing a means for achieving a constantly controllable current level, the igniter/valve combination can be more precisely controlled in order to achieve a device which operates reliably, even in the presence of circuit faults and variations in line voltage.

The foregoing discussion discloses and describes merely an exemplary embodiment of the present invention. One skilled in the art will readily recognize that various changes and modifications can be made thereto without departing from the spirit and scope of the present invention as set forth in the following claims.

What is claimed is:

1. An electronic control circuit for a gas oven comprising:

an electrically actuable heated surface igniter;

an electrically actuable valve, said valve being movable between an opened position wherein gas is permitted to flow across said igniter and a closed position where said flow of gas is prohibited;

a source of alternating electrical current;

a triac; and a controller circuit coupled between said valve and said triac and being adapted to produce a digital signal indicative of the current level through said valve, said controller being further adapted to provide a gating signal to said triac in response to said digital signal in order to achieve a desired current level through said valve.

2. The circuit of claim 1 wherein said controller circuit includes an analog-to-digital converter connected across said valve.

3. The circuit of claim 1 wherein said valve includes a bi-metal heating element and wherein said valve moves between said opened and closed positions in response to the application of electrical current.

4. The circuit of claim 3, wherein the current required to heat said igniter to a temperature sufficient to ignite said gas is below the threshold current for keeping said valve in said closed position.

5. The circuit of claim 1, wherein said electronic control circuit controls the heat produced in a gas oven and wherein said circuit further includes a thermostat switch which closes in response to a call for heat in said oven.

6. The circuit of claim 5, wherein said switch, valve, igniter, triac and said current source are electrically connected in series.

7. The circuit of claim 1, further comprising a current transformer and said controller circuit further including an analog to digital converter, said A/D converter being connected across a secondary winding of said transformer and a primary winding of said transformer being connected in electrical series with said valve.

8. A method for controlling the application of heat to a gas oven, said method comprising the steps of:

providing a heated surface igniter in the path of the flow of a gas;

providing an electrically actuable valve which moves between an opened position which allows gas to flow across said igniter and a closed position in which gas is prevented from flowing, said valve being moved between said positions in response to the level of applied electrical current;

applying an electrical signal to said igniter and said valve, said signal being pulse density modulated, and monitoring the level of current in said applied electrical signal and in response thereto, adjusting the density of current pulses applied to said igniter to achieve a desired current level.

9. The method of claim 8, wherein a triac is electrically connected in series with said valve and said igniter, and said triac is utilized to adjust said pulse density.

10. The method of claim 9 wherein said triac, igniter and valve are connected in series.

11. The method of claim 8, further including the step of converting said monitored current level to a digital value.

12. The method of claim 11, further including the step of providing a microprocessor electrically coupled to said triac, said microprocessor providing gating signals to said triac in response to said digital value.

13. The method of claim 8, further including the step of electrically connecting a current transformer electrically in series with said valve, said transformer being used to generate a measurement indicative of said level of current in said applied signal.

* * * * *